US006155781A

United States Patent [19]

Tsai

[11] Patent Number: 6,155,781

[45] Date of Patent: Dec. 5, 2000

[54] PORTABLE ELECTRIC AIR PUMP

[76] Inventor: Cheng-Chang Tsai, P.O. Box 82-144, Taipei, Taiwan

[21] Appl. No.: 09/285,443

[22] Filed: Apr. 2, 1999

[51] Int. Cl.[7] ..... F01D 1/02

[52] U.S. Cl. ..... 415/206; 415/182.1; 415/204; 415/207; 415/211.1; 415/214.1; 415/213.1; 416/185

[58] Field of Search ..... 415/182.1, 204, 415/206, 207, 211.1, 211.2, 213.1, 214.1, 212.1; 416/185

[56] References Cited

U.S. PATENT DOCUMENTS

| | | | |
|---|---|---|---|
| 3,809,504 | 5/1974 | Goossens | 417/411 |
| 5,554,004 | 9/1996 | Stewart | 416/185 |
| 5,848,875 | 12/1998 | San-Jou | 415/182.1 |
| 5,967,744 | 10/1999 | Danner | 417/411 |

*Primary Examiner*—Edward K. Look
*Assistant Examiner*—Hermes Rodriguez
*Attorney, Agent, or Firm*—A & J

[57] ABSTRACT

An air pump includes a housing having a top formed with a circular recess, a first semi-cylindrical member in communication with the circular recess, and a first curved baffle arranged close to the first semi-cylindrical member, an electric motor mounted within the housing and having an output axle extending upwardly out of the center through hole, a bottom cover engaged with a bottom of the housing by retainers, a centrifugal impeller eccentrically fitted in the circular recess so that there is a circular passage between the centrifugal impeller and an inner wall of the circular recess, an upper cover configured to engage with the circular recess to cover the centrifugal impeller and having a conical portion disposed above the centrifugal impeller thereby forming a passage therebetween, whereby the air pump can provide sufficient air pressure to inflate an object in a short time.

2 Claims, 5 Drawing Sheets

PORTABLE ELECTRIC AIR PUMP

BACKGROUND OF THE INVENTION

1. Field of the Invention

This invention is related to an improvement in the structure of a portable electric air pump.

2. Description of the Prior Art

Referring to FIG. 1, the conventional portable electric air pump A1 includes a cylindrical housing in which are mounted a battery, an electric motor and an impeller A2. The battery supplies power to the electric motor which in turn drives the impeller A2 to generate air current for inflation. However, such a portable electric air pump A1 suffers from the following drawbacks:

1. The air current generated by such an air pump is low in pressure thereby making it impossible to inflate sufficient air into an inflatable object.
2. Such an air pump works just like an electric fan and which is low in efficiency and cannot provide high pressure
3. As such air pump is cylindrical in shape, it is difficult to hold the air pump firmly thus making it inconvenient to carry.

Therefore, it is an object of the present invention to provide an improvement in the structure of a portable electric air pump which can obviate and mitigate the above-mentioned drawbacks.

SUMMARY OF THE INVENTION

This invention is related to an improved portable electric air pump.

It is the primary object of the present invention to provide an improved portable electric air pump which can produce high pressure air current.

It is another object of the present invention to provide an improved portable electric air pump which can prevent air current from flowing back from an inflatable object.

It is still another object of the present invention to provide an improved portable electric air pump which utilizes a centrifugal impeller to produce high pressure air current.

It is still another object of the present invention to provide an improved portable electric air pump which can be used for inflating or deflating an inflatable object.

It is a further object of the present invention to provide an improved portable electric air pump which is simple in construction and easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
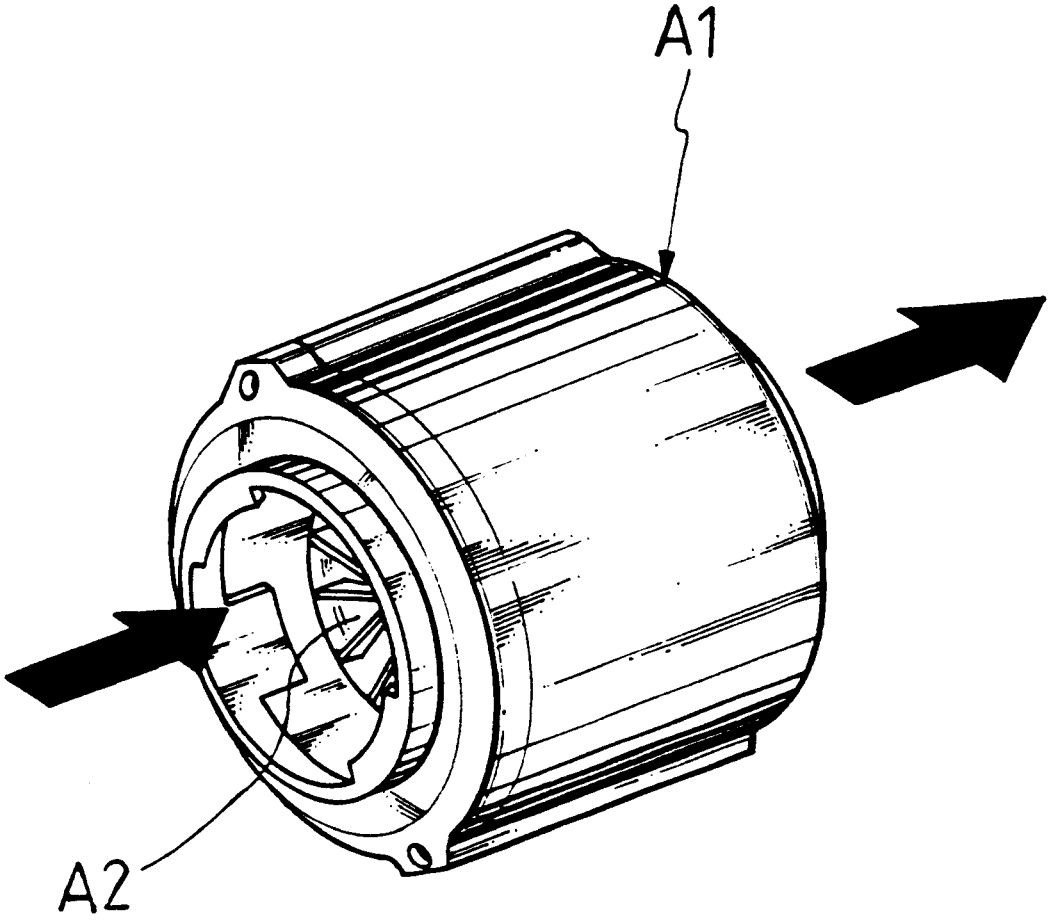
PRIOR ART FIG. 1
FIG. 1 is a perspective view of a prior art portable electric air pump.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
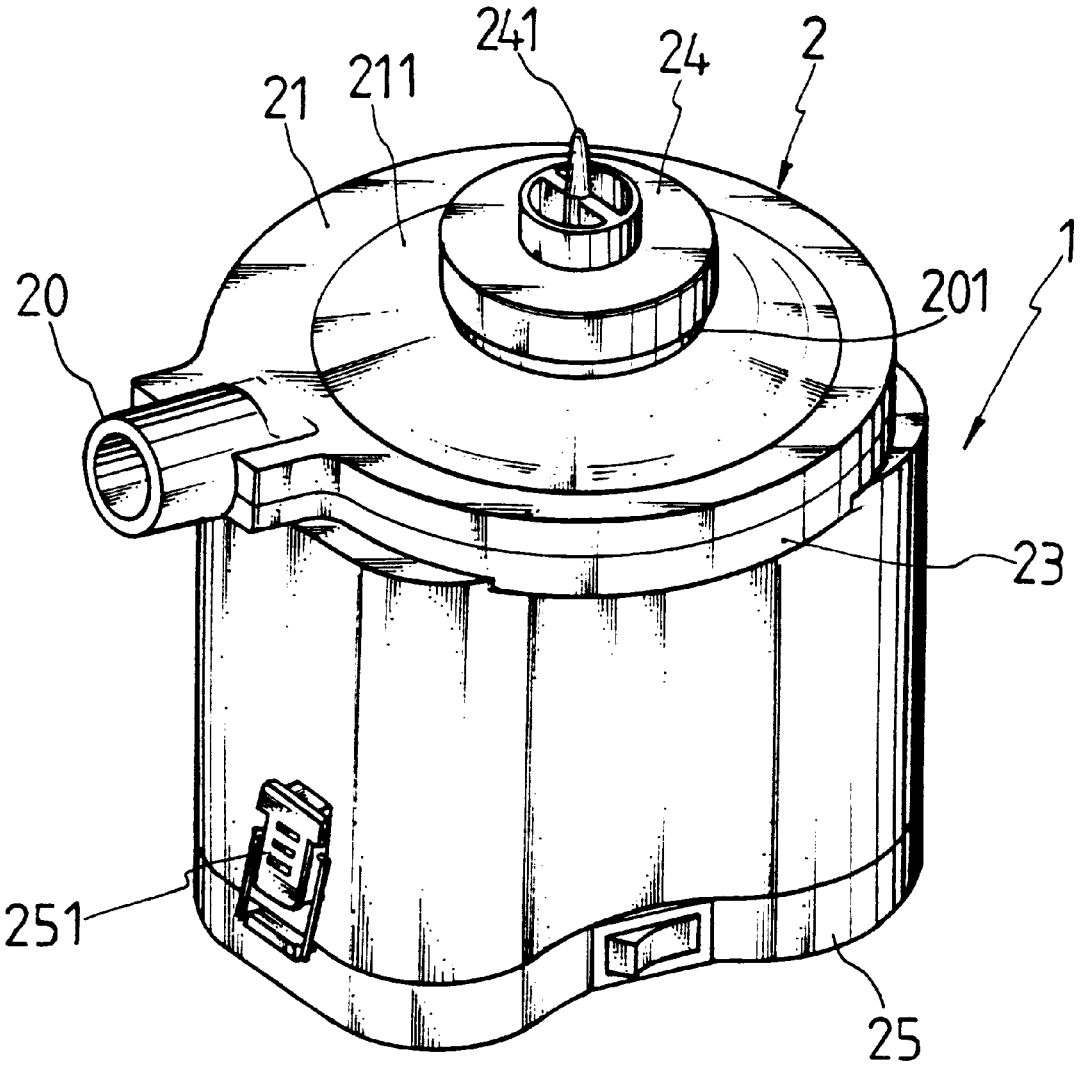
FIG. 2 is a perspective view of the present invention.
Figure 3:
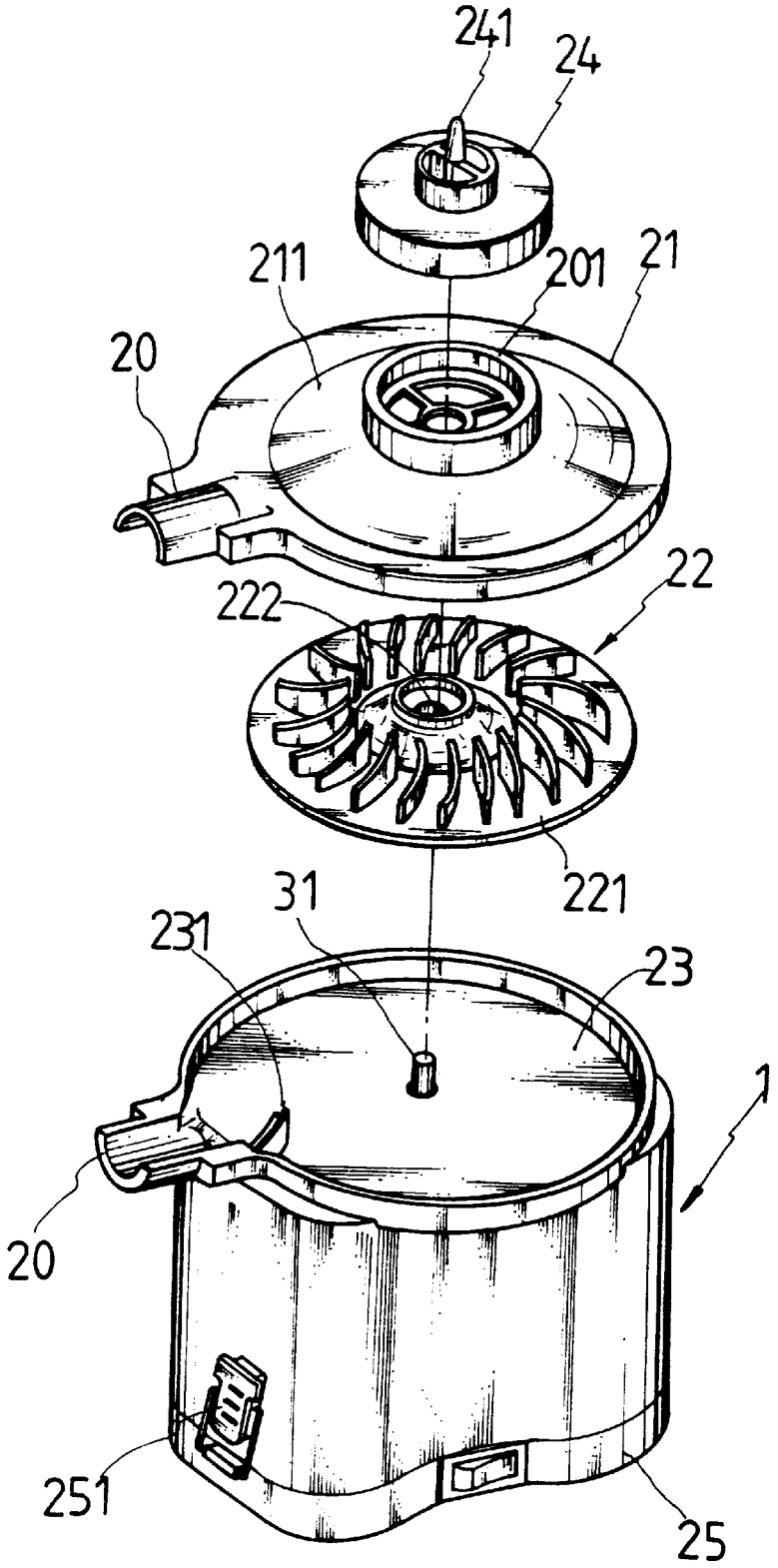
FIG. 3 is an exploded view of the present invention.
Figure 4:
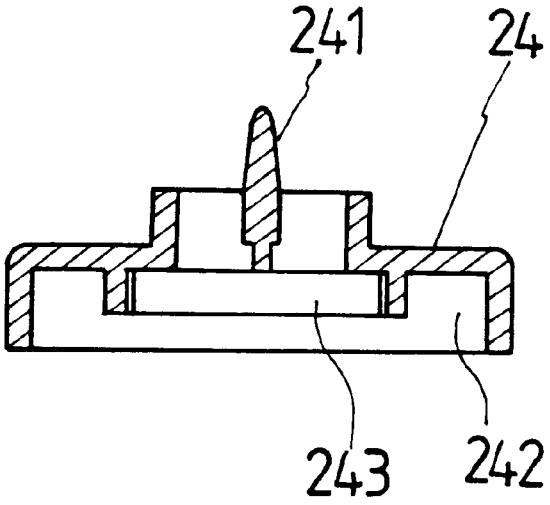
FIG. 4 is a sectional view of the cap.

With reference to the drawings and in particular to FIGS. 2 and 3 thereof, the portable electric air pump according to the present invention generally comprises a housing 1 and a chamber 2 arranged on the top of the housing 1.

The housing 1 is formed at the top with a circular recess 23, a semi-cylindrical member 20 in communication with the circular recess 23, and a curved baffle 231 arranged close to the semi-cylindrical member 20. An electric motor 3 is mounted within the housing 1 and has an output axle 31 extending upwardly out of a center hole of the circular recess 23. A battery (not shown) is arranged inside the housing 1 for supplying power to the electric motor 3. A bottom cover 25 is engaged with the bottom of the housing 1 by retainers 251 (only one is shown in FIG. 3).

Figure 5:
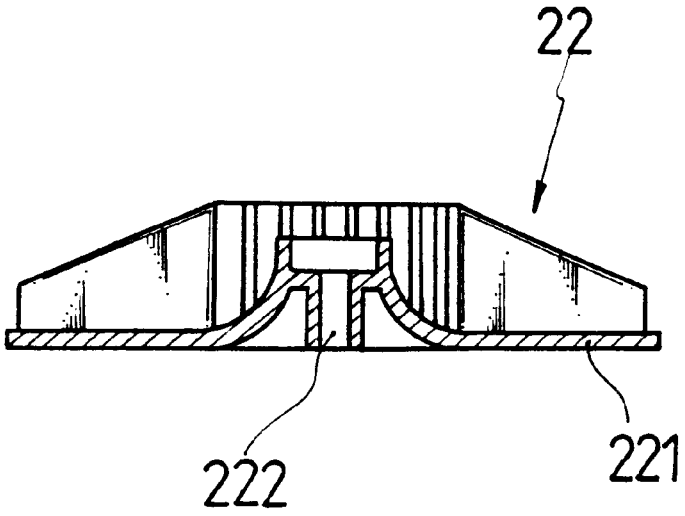
FIG. 5 is a sectional view of the impeller.
Figure 6:
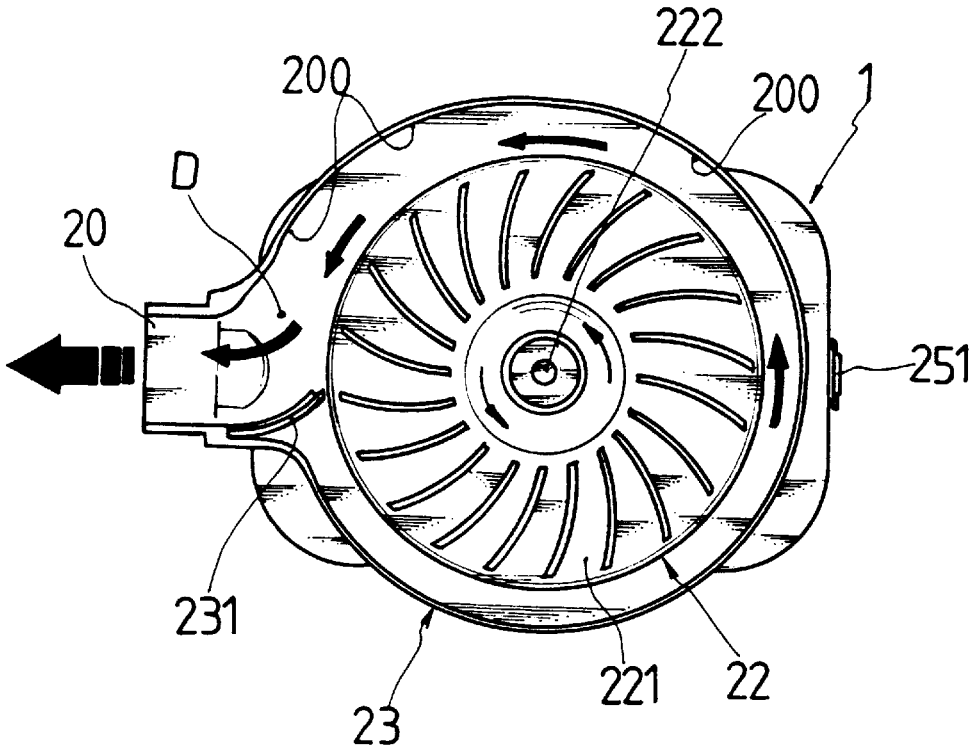
FIG. 6 is a top view of the present invention.
Figure 7:
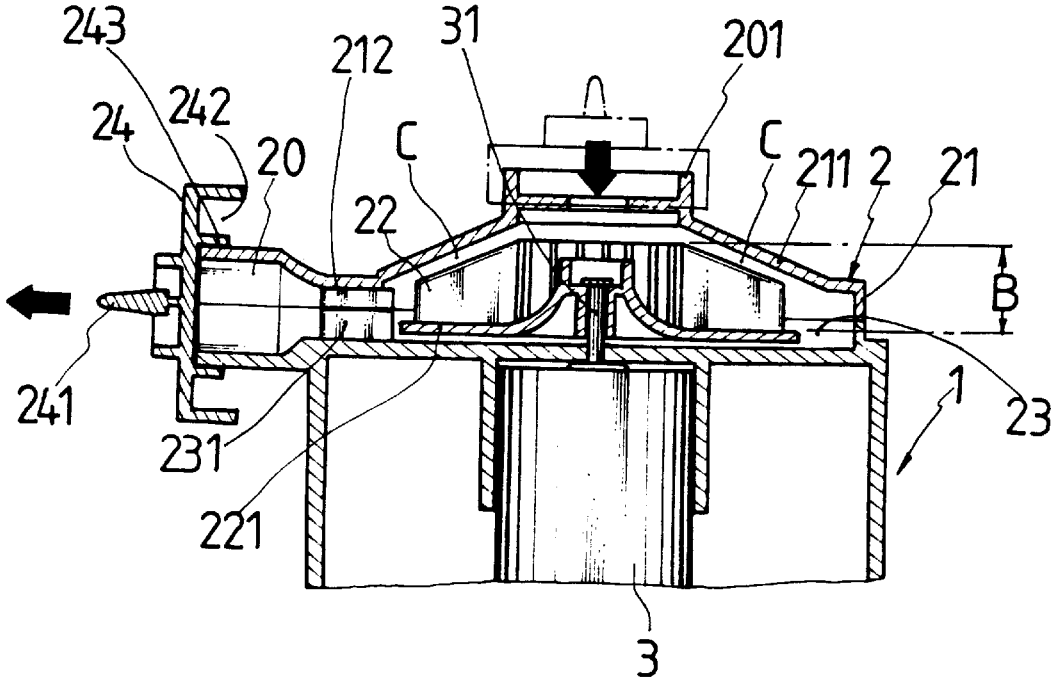
FIG. 7 is a sectional view of the present invention.

A centrifugal impeller 22 is eccentrically fitted in the circular recess 23 so that there is a circular passage D between the centrifugal impeller 22 and the inner wall 200 of the circular recess 23 (see FIG. 6). The circular passage D is gradually increased in width with the curved baffle 231 to the outlet 20. The centrifugal impeller 22 has a center hole 222 receiving the output axle 31 of the electric motor 3. The centrifugal impeller 22 is fixedly connected with the output axle 31 of the electric motor 3 by threading means or the like so that the centrifugal impeller 22 will be rotated with the output axle 31 of the electric motor 3. As shown in FIGS. 3, 5 and 7, the impeller 22 includes a circular disc 221 on which are mounted a plurality of curved blades each having an inner end with a height B. The curved blade is gradually decreased in height from the inner to the outer ends thereof.

Referring to FIGS. 2, 3 and 7, the top of the housing 1 is closed with an upper cover 21 which is configured to engage with the circular recess 23 of the housing 1 so as to cover the centrifugal impeller 22. The upper cover 21 has a conical portion 211 disposed above the centrifugal impeller 22 thus forming a passage C therebetween. The upper cover 21 is provided with a semi-cylindrical portion 20 adapted to engage with the cylindrical portion 20 of the housing 1 to form a tubular outlet, and a curved baffle 212 configured to engage with the curved baffle 231 of the circular recess 23. The top of the upper cover 21 is formed with a circular inlet 201 at the central portion thereof, from which air current is drawn into the chamber 2 and then compressed by the centrifugal impeller 22 to go out of the outlet 20.

As shown in FIGS. 2, 3, 4 and 7, a cap 24 which is generally circular is shape is fitted on the circular inlet 201. The top of the cap 24 is provided with a projection 241 for deflating an object. The bottom of the cap 24 is formed with an inner neck 243 and an outer neck 242 configured to engage with the outlet 20 and inlet 201, respectively.

Referring to FIG. 7, when the electric motor 3 is turned on, the centrifugal impeller 22 will be rotated thereby drawing air from the inlet 201 and compressing the air out of the outlet 20 through the passage D thereby providing sufficient pressure to inflate an object.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An air pump comprising:

a housing having a top formed with a circular recess, a first semi-cylindrical member in communication with said circular recess, and a first curved baffle arranged close to said first semi-cylindrical member, said circular recess having a center through hole;

an electric motor mounted within said housing and having an output axle extending upwardly out of said center through hole;

a bottom cover engaged with a bottom of said housing by retainers;

a centrifugal impeller eccentrically fitted in said circular recess so that there is a circular passage between said centrifugal impeller and an inner wall of said circular recess, said circular passage being gradually increased in width with said curved baffle to said outlet, said centrifugal impeller being fixedly connected with said output axle of said electric motor, said impeller including a circular disc on which are mounted a plurality of curved blades which are gradually decreased in height from an inner to an outer ends thereof;

an upper cover configured to engage with said circular recess to cover said centrifugal impeller and having a conical portion disposed above said centrifugal impeller thereby forming a passage therebetween, said upper cover having a second semi-cylindrical portion adapted to engage with said first cylindrical portion to form a tubular outlet, and a second curved baffle configured to engage with said first curved baffle, a top of said upper cover being formed with a circular inlet at a central portion thereof.

2. The air pump as claimed in claim 1, farther comprising a cap which is generally circular is shape and fitted on said circular inlet, said cap having a top provided with a projection and a bottom formed with an inner neck and an outer neck configured to engage with said outlet and inlet respectively.

* * * * *